US006283003B1

(12) United States Patent
Hanson et al.

(10) Patent No.: US 6,283,003 B1
(45) Date of Patent: Sep. 4, 2001

(54) KNIFE ATTACHMENT FOR A SHEET CUTTING SYSTEM

(75) Inventors: David L. Hanson, Wyoming; Daniel F. Johnson, Burns, both of MN (US)

(73) Assignee: Safety Speed Cut Manufacturing Company, Inc., Anoka, MN (US)

( * ) Notice: Subject to any disclaimer, the term of this patent is extended or adjusted under 35 U.S.C. 154(b) by 0 days.

(21) Appl. No.: 09/062,851

(22) Filed: Apr. 20, 1998

(51) Int. Cl.[7] ..... B26D 1/04; B26D 7/26

(52) U.S. Cl. ..... 83/614; 83/698.31; 83/698.41

(58) Field of Search ..... 83/455, 614, 640, 83/699.31, 699.41, 699.51, 699.61, 574, 578, 581, 56, 544, 546, 563, 881, 821, 32.3

(56) References Cited

U.S. PATENT DOCUMENTS

| | | | | |
|---|---|---|---|---|
| 286,422 | | 10/1883 | Gaylord | 83/455 |
| 570,180 | * | 10/1896 | McCall | 83/581 |
| 2,013,893 | * | 9/1935 | Matthews | 83/455 |
| 2,835,037 | | 5/1958 | Middents | 33/485 |
| 3,463,041 | | 8/1969 | Shapiro et al. | 83/564 |
| 3,527,131 | * | 9/1970 | Ellerin | 83/614 X |
| 3,866,496 | | 2/1975 | Payne et al. | 83/471.3 |
| 3,964,360 | | 6/1976 | Schwartz | 83/464 |
| 3,967,519 | | 7/1976 | Esterly | 83/455 |
| 3,996,827 | | 12/1976 | Logan | 83/455 |
| 4,038,751 | | 8/1977 | Albright | 30/293 |
| 4,058,150 | | 11/1977 | Pennington | 144/1.1 |
| 4,176,572 | | 12/1979 | Pennington | 83/862 |
| 4,802,399 | | 2/1989 | Olson | 83/425 |
| 4,871,156 | * | 10/1989 | Kozyrski et al. | 83/614 X |
| 5,309,642 | * | 5/1994 | McGinnis | 83/614 X |
| 5,603,253 | * | 2/1997 | Logan | 83/614 X |

OTHER PUBLICATIONS

Sawtrax—Coroplast Cutting Knife Attachment—4 pps., Mar. 11, 1998.

* cited by examiner

*Primary Examiner*—Clark F. Dexter
(74) *Attorney, Agent, or Firm*—Ohlandt, Greeley, Ruggiero & Perle, LLP

(57) ABSTRACT

There is provided a knife attachment that is interchangeable with a saw attachment for a sheet cutting system. The knife attachment has a base plate to which is attached a cutting head that carries a blade holder. The blade holder is adjustable for depth penetration as well as for angle of approach to the work piece.

6 Claims, 3 Drawing Sheets

KNIFE ATTACHMENT FOR A SHEET CUTTING SYSTEM

FIELD OF INVENTION

This invention relates to a sheet cutting system and, in particular, to a knife attachment that is interchangeable with a panel saw attachment for a sheet cutting system.

BACKGROUND OF INVENTION

Systems for cutting sheet material, such as mat, sheet rock, cardboard, wood panel and the like, have been known for many years. Exemplary mat cutting systems are disclosed in U.S. Pat. Nos. 286,422; 2,835,037; 3,996,827; 3,463,041; 3,964,360; 3,967,519; 4,038,751; 4,867,023; and, 5,272,947. Exemplary large or construction sheet material (for example, 4×8 feet size) cutting systems are disclosed in U.S. Pat. Nos. 3,866,496; 4,058,150, 4,176,572; 4,802,399; and, 5,582,088.

The prior art mat cutting systems generally use a knife or blade. The cutting heads that hold these knives range from simple to complex. However, most of these heads are designed for a mat cutting operation and are not durable, easy to manufacture and easy to use in commercial graphic arts and construction type applications.

Construction type cutting systems are typified by the aforementioned U.S. Pat. No. 4,802,399 to Olson. This patent discloses an A-frame type support for holding a construction size work piece for cutting by a saw attachment on a carriage. The carriage is arranged for travel on a pair of rails and guide tubes to saw a cut through the work piece.

The inventors of the present invention are aware of a knife attachment, Utility Knife Attachment available from Saw Trax Mfg. of Acworth, Ga., for a construction type cutting system. This attachment merely uses an utility knife fastened to a sheet metal bracket. This attachment is not rigid and does not achieve the desired accuracy in use.

SUMMARY OF THE INVENTION

An object of the present invention is to provide a durable knife attachment for commercial graphic arts and construction cutting systems.

Another object of the present invention is to provide such a knife attachment that is easy to assemble, easy to use, easy to change blades, and easy to adjust for depth penetration and for blade angle.

These and other objects of the present invention are fulfilled by a knife attachment that has a base with a top surface and a bottom surface. The bottom surface faces a work piece which is supported by a frame. The base has a hole extending between its top and bottom surfaces. An elongated blade holder extends through the hole. The blade holder has a first slot extending therethrough and along the length dimension of the blade holder. A mounting plate is adapted to be mounted to the top surface of the base. A structure, such as a screw and a post, is mounted on the mounting plate and is slidably disposed in the first slot to define a depth penetration path along the blade holder length dimension. This allows the blade holder to slide toward and away from the work piece. The screw is preferably a carriage bolt that is operable to lock the blade holder to a desired penetration depth.

In another embodiment, a second slot extends through the mounting plate. The carriage bolt is also slidably disposed in the second slot and arranged when tightened to lock the blade holder to both a desired penetration depth and to a desired angle with respect to the work piece.

In still another embodiment, a backer board has a third slot. The backer board is disposed behind the work piece with the third slot in alignment with the blade. The backer board gives continuous support to the work piece in the region of the cut and provides a path for the blade during cutting operations.

BRIEF DESCRIPTION OF DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENTS

Figure 1:
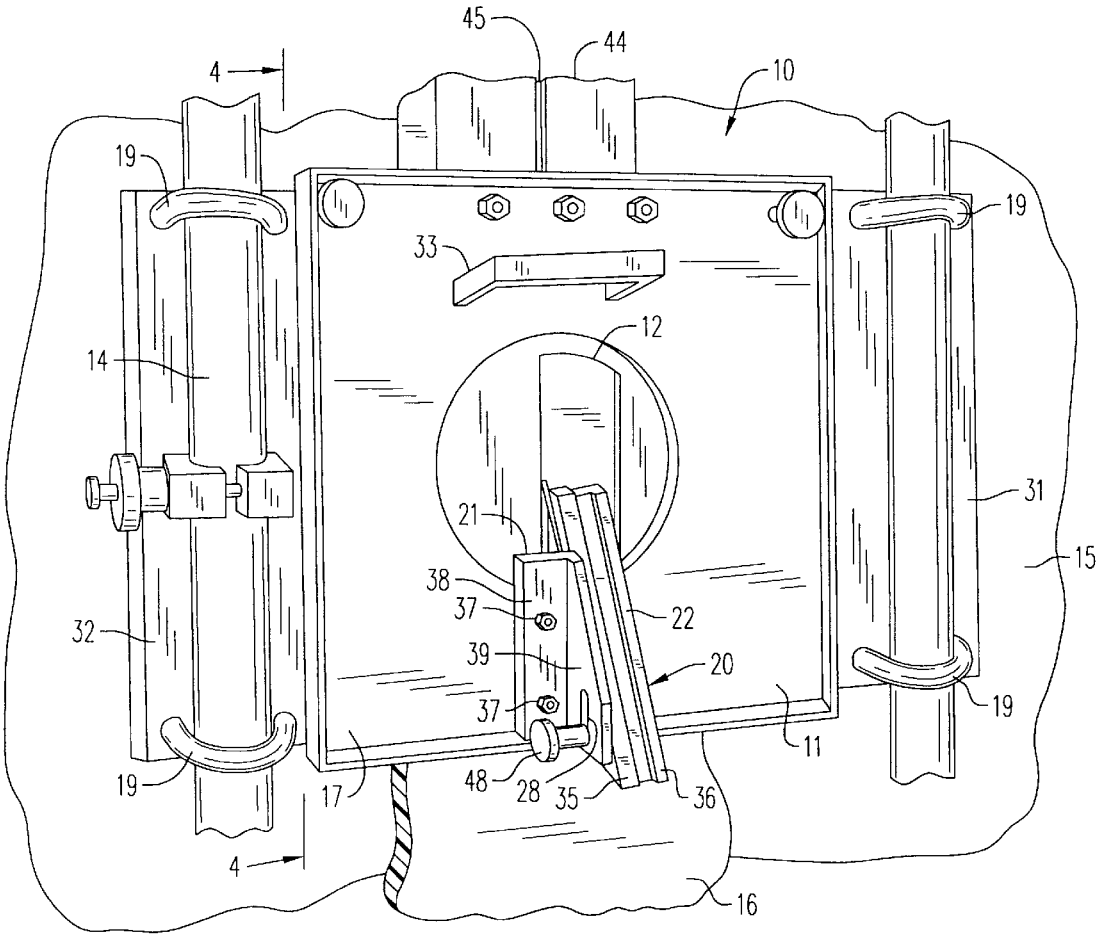
FIG. 1 is a perspective view of the knife attachment of the present invention mounted to a construction type cutting system.
Figure 4:
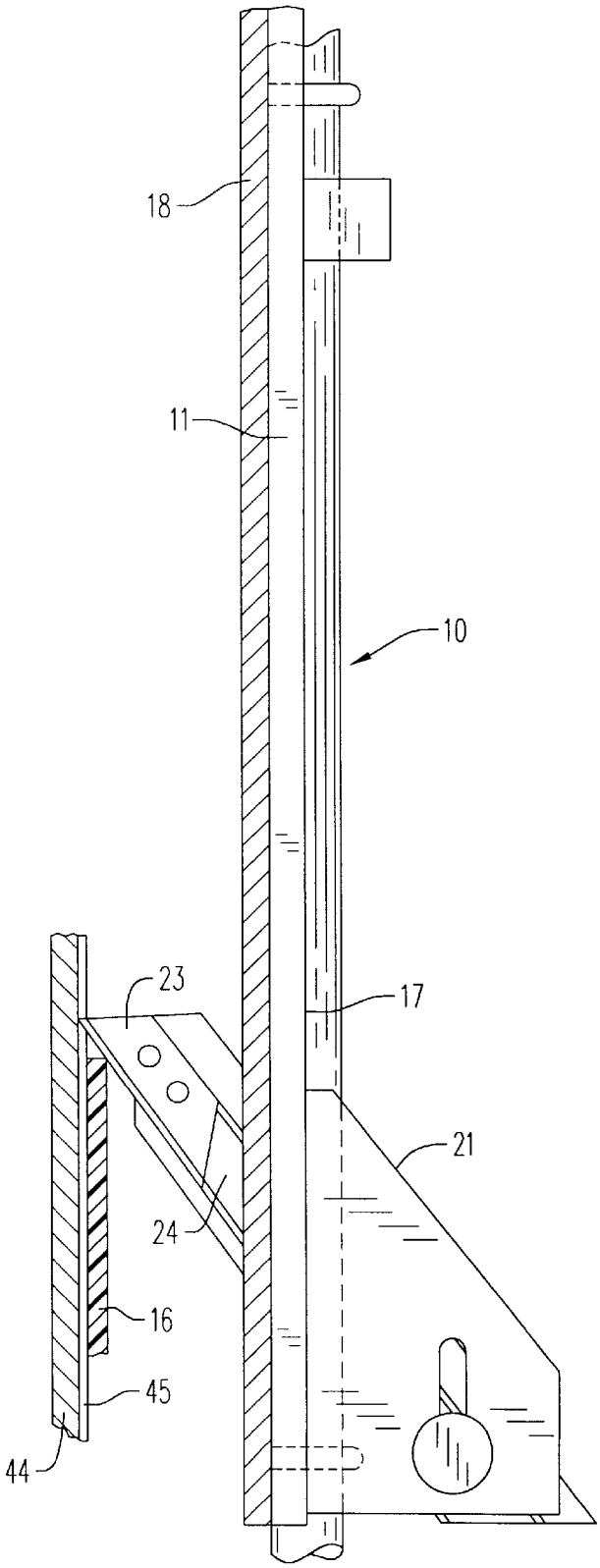
FIG. 4 is a cross sectional view taken along the lines 4—4 of FIG. 1.

With reference to FIGS. 1 and 4, there is provided a knife attachment generally represented by numeral 10. The knife attachment 10 has a base plate 11 with a top surface 17 and a bottom surface 18. Bottom surface 18 faces a work piece 16. (Only a portion of work piece 16 is shown in FIG. 1.) Base plate 11 has a hole 12 extending therethrough.

A construction cutting system frame 15 is partially shown. By means not shown, frame 15 supports work piece 16 and a pair of spaced apart and substantially parallel guide tubes 13 and 14. Base plate 11 has extensions 31 and 32 that have U type fasteners 19 for slidably engaging guide tubes 13 and 14 to allow knife attachment 10 to slide along the guide tubes. Knife attachment 10 has a handle 33 to facilitate manual operation in moving it along guide tubes 13 and 14.

A cutting head 20 has a mounting plate 21 that is mounted to top surface 17. Mounting plate 21 has a first body portion 38 that is substantially parallel to top surface 17 of base plate 11 and fastened thereto by conventional fastener means, such as, for example, screws 37. Mounting plate 21 also has a second body portion 39 extending at substantially a right angle to body portion 38 and away from base plate 11.

A blade holder 22 has first and second elongated body portions 35 and 36 which are generally perpendicular to top surface 17 and bottom surface 18 of base plate 11. Blade holder 22 extends through hole 12 toward work piece 16. A blade 23 is situated in a channel 24 located on one side of first body portion 35 of blade holder 22 and at a distal end from mounting plate 21. The cutting edge of blade 23 is substantially perpendicular to work piece 16 so as to make a substantially right angle cut therethrough. First body portion 35 of blade holder 22 has a first slot 25 extending therethrough along the length dimension of the blade holder. Second body portion 36 of blade holder 22 is a stiffener to hold first body portion 35 straight and to prevent deflection in use.

Figure 2:
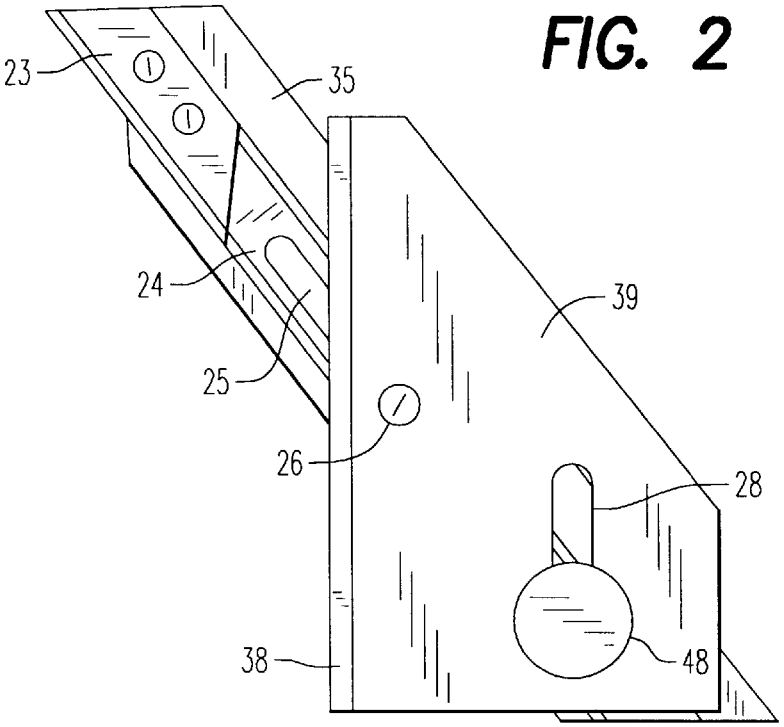
FIG. 2 is side view of the cutting head of the knife attachment of FIG. 1.
Figure 3:
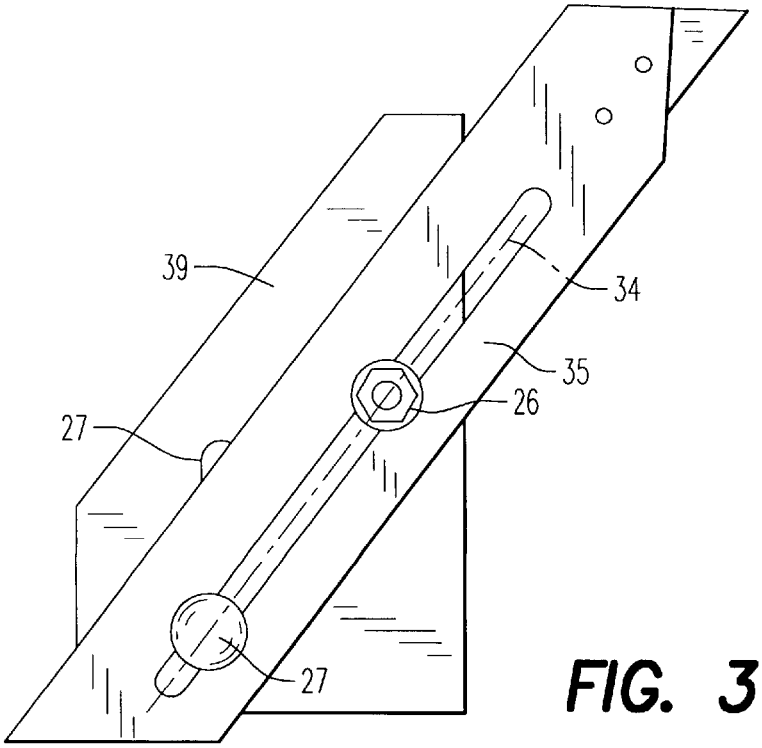
FIG. 3 is an opposite side view of the cutting head of the knife attachment of FIG. 1.

Mounting plate 21 has a structure, such as an idle post 26 and an adjusting member 27, extending through its second body portion 39 and into first slot 25 to define a depth penetration path 34 (FIG. 3) along the length dimension of blade holder 22. Post 26 preferably takes the form of a pin or a carriage bolt that is secured in place and not adjustable. Adjusting member 27 preferably takes the form of a carriage bolt with a hand knob 48 shown in FIGS. 1 and 2. Idle pin 26 and adjusting member 27 are slidably disposed in first slot 25 so that blade holder 22 is adjustable along depth penetration path 34 to a desired depth position at which the adjusting member is manually tightened to lock blade holder 22 to such desired position. In the illustrated embodiment, blade holder 22 and depth penetration path 34 are at substantially a 45° angle with respect to top and bottom surfaces 17 and 18 of base plate 11 and to work piece 16, and in a plane that is substantially perpendicular to base plate 11 and work piece 16.

The angle of blade holder 22 with respect to work piece 16 can be adjusted in such perpendicular plane. To adjust the angle of blade holder 22 with respect to work piece 16, second body portion 39 of mounting plate 21 has a second slot 28 that extends therethrough. Adjusting member 27 is slidably disposed within second slot 28 so that the angle of blade holder 22 with respect to work piece 16 is adjustable within limits allowed by the length of the second slot. To select a desired angle, blade holder 22 is moved within second slot 28 to the desired angle and then adjusting member 27 is tightened to lock the blade holder 22 to the desired angle.

With reference to FIGS. 1 and 4, a backer board 44 is supported on frame 15 behind work piece 16. Backer board 44 gives support to work piece 16 in the region where the cut is to be made. Backer board 44 has a slot 45. Slot 45 is in substantial alignment with blade 23 to provide a cutting channel for the blade during cutting operations.

The knife attachment 10 of the present invention is not only durable, but also versatile to cut sheet material having a wide range of thickness (for instance, from on the order of 0.010 inch to on the order of 0.75 inch) and having a wide range of sizes that include 4 by 8 feet and even larger. In addition, the knife attachment 10 can be used in scoring operations on sheet rock, wood panel, hard plastic and the like.

The present invention having been thus described with particular reference to the preferred forms thereof, it will be obvious that various changes and modifications may be made therein without departing from the spirit and scope of the present invention as defined in the appended claims.

What is claimed is:

1. A knife attachment for a sheet cutting system having a frame that supports a work piece, said knife attachment comprising:

a base having a top surface and a bottom surface, said base having a hole extending therethrough between said top and bottom surfaces;

an elongated blade holder having a length dimension and having a distal end, said blade holder extending through said hole and being disposed in a plane that is substantially perpendicular to said base, said blade holder having a first slot extending therethrough and extending along said length dimension of said blade holder;

a mounting plate mounted on said top surface;

sliding means situated in said first slot to allow said blade holder to slide along said length dimension, said sliding means being mounted on said mounting plate in a manner to define a depth penetration path along said length dimension of said blade holder, said sliding means including a post and an adjusting member, and wherein said adjusting member and said mounting plate cooperate to lock said blade holder to said mounting plate to define a desired penetration depth; and wherein said mounting plate includes a second slot having a length and extending therethrough, said adjusting member being slidably positioned in said second slot and adjustable to lock said blade holder to said mounting plate to define (a) said desired penetration depth and (b) a desired angle in a plane substantially perpendicular to said base, said angle being within a range defined by said length of said second slot.

2. The knife attachment according to claim 1, wherein said adjusting member is a carriage bolt.

3. The knife attachment according to claim 1, wherein said mounting plate further includes:

a first body portion that is substantially parallel to said top surface and is fastened thereto; and a second body portion that extends substantially perpendicular to said first body portion and away from said top surface, wherein said sliding means are mounted on said second body portion.

4. The knife attachment according to claim 3, wherein said blade holder includes a first blade holder body portion in which said first slot is situated, said first blade holder body portion having a channel in one side thereof to receive a blade, and wherein said first slot extends through said first blade holder body portion.

5. The knife attachment according to claim 4, wherein said blade holder further includes a second blade holder body portion connected to said first blade holder body portion for stiffening said blade holder during use.

6. The knife attachment according to claim 1, wherein the knife attachment is used with a backer board disposed substantially parallel to said bottom surface of said base whereby the work piece is between said backer board and said bottom surface of said base, said backer board having a groove disposed therein to receive a portion of said blade which penetrates through the work piece.

* * * * *